US007210599B1

(12) United States Patent
Pfaff et al.

(10) Patent No.: US 7,210,599 B1
(45) Date of Patent: May 1, 2007

(54) DECORATIVE AND LIQUID DISPENSER AIR GAP ASSEMBLY COVERS

(76) Inventors: Mary L. Pfaff, W350 S3119 Waterville Rd., Oconomowoc, WI (US) 53066; Roxanne J. Vincent, 34913 Valley Rd., Oconomowoc, WI (US) 53066

( * ) Notice: Subject to any disclaimer, the term of this patent is extended or adjusted under 35 U.S.C. 154(b) by 493 days.

(21) Appl. No.: 10/823,520

(22) Filed: Apr. 13, 2004

(51) Int. Cl.
*B05B 11/00* (2006.01)

(52) U.S. Cl. ..... 222/78; 222/321.7

(58) Field of Classification Search ..... 222/78, 222/179.5, 173, 621, 255, 327.1, 321.8, 383.1; 220/521; 215/378
See application file for complete search history.

(56) References Cited

U.S. PATENT DOCUMENTS 923,447 A * 6/1909 Schmidt ..... 222/180
4,239,208 A 12/1980 Walls ..... 272/67
5,476,197 A * 12/1995 Lawrence et al. ..... 222/321.7
5,624,064 A * 4/1997 McGee, Jr. ..... 224/414
5,634,871 A 6/1997 Froelich, Sr. et al. ..... 482/46
6,345,736 B1 * 2/2002 Berry et al. ..... 222/211
6,390,340 B1 * 5/2002 Lynch, Sr. ..... 222/399
6,748,966 B1 * 6/2004 Dvorak ..... 137/216
6,910,604 B2 * 6/2005 Gugliotti et al. ..... 222/179.5
2001/0035429 A1 * 11/2001 Colquhoun ..... 222/93

* cited by examiner

*Primary Examiner*—Lien M. Ngo
(74) *Attorney, Agent, or Firm*—Donald J. Ersler

(57) ABSTRACT

The decorative air gap cover includes a base cover and a decorative attachment. The base cover includes a cup body and a cover fastener on a top thereof. The decorative attachment includes a decorative body and a decorative fastener on a bottom thereof. The cover fastener and the decorative fastener mate with each other to allow the decorative attachment to be retained on a top of the base cover. A liquid dispenser air gap cover includes the base cover and a liquid dispenser attachment. The liquid dispenser attachment includes a liquid container, a liquid pump and a liquid fastener on a bottom of the liquid container. The cover fastener of the base cover and the liquid fastener mate with each other to secure the liquid dispenser to a top of the base cover.

11 Claims, 5 Drawing Sheets

DECORATIVE AND LIQUID DISPENSER AIR GAP ASSEMBLY COVERS

BACKGROUND OF THE INVENTION

1. Field of the Invention

The present invention relates generally to air gap covers and more specifically to decorative and liquid dispenser air gap assembly covers, which may be used to replace a prior art air gap cover.

2. Discussion of the Prior Art

Air gap assemblies are used for preventing backflow from a waste line to a dishwasher or any other appliance connected to the waste line. A top end of the air gap assembly is typically placed adjacent a sink in a kitchen. An air gap cover terminates the top end of the air gap assembly. The air gap cover includes an air intake slot for preventing an overflow of sewage into the dishwasher or any other appliance. However, it appears that all air gap covers are plain and unexciting.

Accordingly, there is a clearly felt need in the art for decorative and liquid dispenser air gap assembly covers that replace a prior art air gap assembly cover.

SUMMARY OF THE INVENTION

The present invention provides decorative and liquid dispenser air gap assembly covers, which replace a prior art air gap assembly cover. The decorative air gap cover includes a base cover and a decorative attachment. The base cover includes a cup body and a cover fastener formed in a top thereof. An air slot is formed through a wall of the cup body and an inner perimeter of the cup body is sized to be snapped on to a top of an air gap assembly. However, the cup body may also be retained with at least one fastener. The decorative attachment includes a decorative body and a decorative fastener on a bottom thereof. The cover fastener and the decorative fastener mate with each other to allow the decorative attachment to be secured on a top of the base cover.

The liquid dispenser air gap cover includes the base cover and a liquid dispenser attachment. The liquid dispenser attachment includes a liquid container and a liquid pump. The liquid container includes a neck on a top and a liquid fastener on a bottom thereof. The cover fastener of the base cover and the liquid fastener mate with each other to allow the liquid dispenser to be secured to a top of the base cover. The liquid pump includes a draw tube, a pump mechanism, a cap insert and a dispensing tube. The neck is sized to receive the cap insert. The cap insert is formed on a top of the pump mechanism. The dispensing tube extends from the top of the pump mechanism and the draw tube extends from a bottom of the pump mechanism. A liquid such as soap or the like is poured into the liquid container and the liquid pump is inserted into the neck. A second embodiment of the liquid dispenser air gap cover includes a base cover formed as an integral portion of a liquid container.

Accordingly, it is an object of the present invention to provide a decorative air gap cover that replaces a prior art air gap assembly cover.

Finally, it is another object of the present invention to provide a liquid dispenser air gap assembly cover that replaces a prior art air gap cover.

These and additional objects, advantages, features and benefits of the present invention will become apparent from the following specification.

DETAILED DESCRIPTION OF THE PREFERRED EMBODIMENTS

Figure 1:
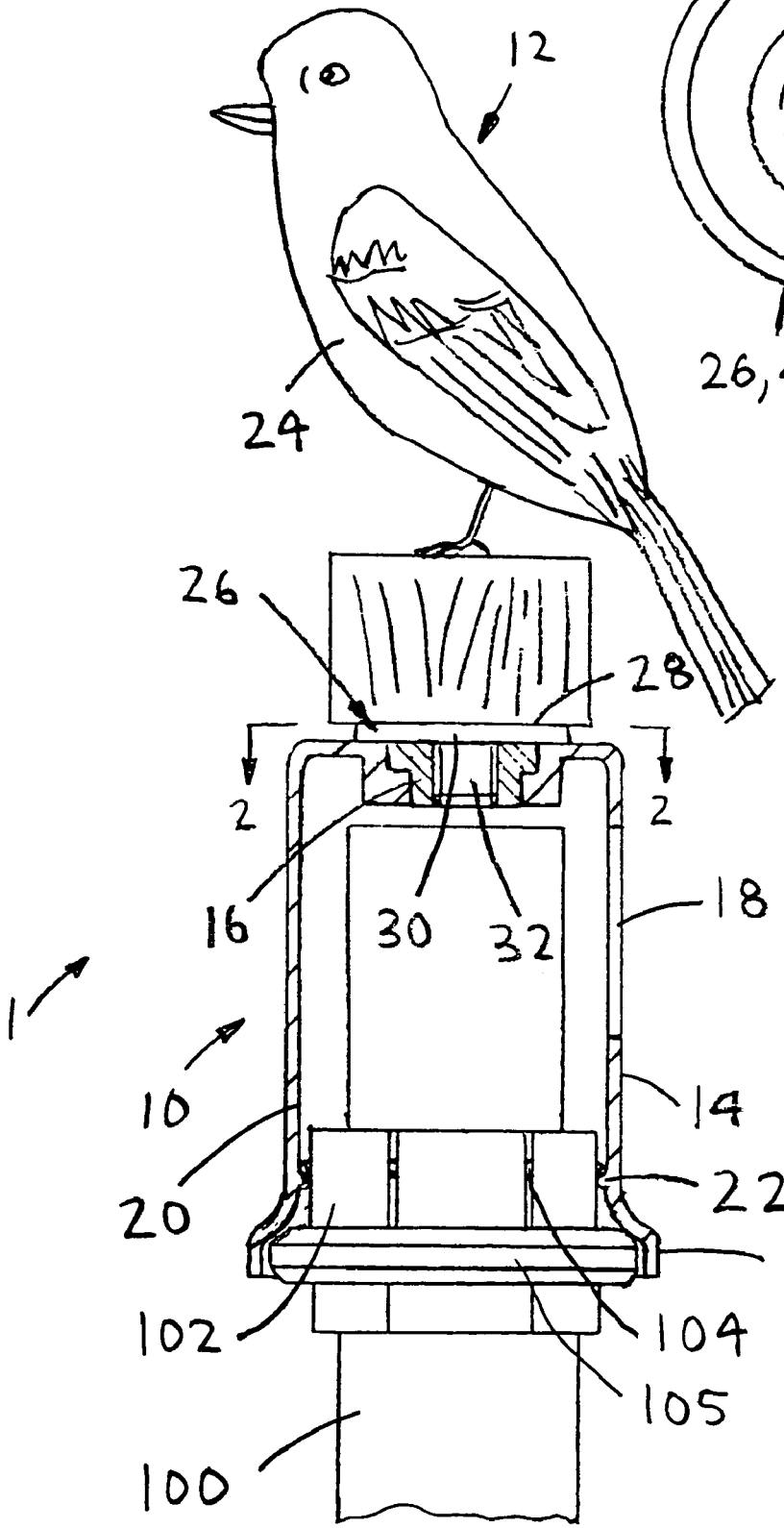
FIG. 1 is a cross sectional view of a decorative air gap cover attached to a top of an air gap assembly in accordance with the present invention.
Figure 2:
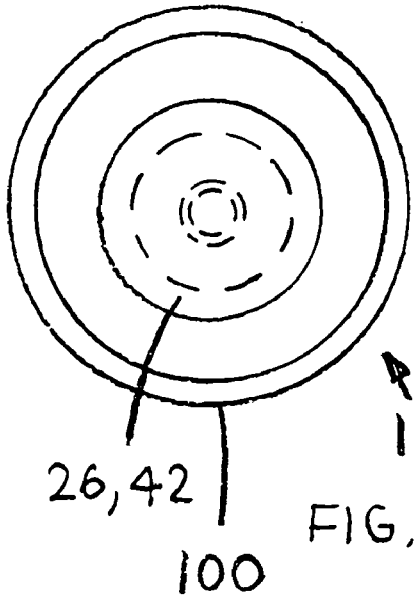
FIG. 2 is a top view of a decorative fastener attached to a base cover of a decorative air gap cover and the decorative air gap cover attached to a top of an air gap assembly in accordance with the present invention.

With reference now to the drawings, and particularly to FIG. 1, there is shown a cross sectional view of a decorative air gap cover 1. With reference to FIG. 2, the decorative air gap 1 includes a base cover 10 and a decorative attachment 12. The base cover 10 includes a cup body 14 and a cover fastener 16. The cup body 14 is preferably formed from a molded plastic, but other materials may also be used. The cover fastener 16 is preferably molded into a top of the cup body 14, but other assembly methods may also be used. An air slot 18 is formed through a wall of the cup body 14. An inside perimeter 20 of the cup body 10 is sized to be received by a top of an air gap 100.

A snap projection 22 is formed on the inside perimeter 20 of the cup body 14 at substantially a bottom thereof. The snap projection 22 is sized to snap over a cover projection 104 formed on a gap nut 102 of the air gap 100. A flared end 23 is preferably formed on a bottom of the cup body 14 to cover a washer 105 of the air gap 100. However, some types of air gaps include a screw on air gap cover. Further, the cup body 14 may also be retained with at least one fastener. The use of screw threads or fasteners to retain the cup body are methods of releasable securement. The inside perimeter 20 of the air cup body 14 may be modified to accommodate any of type attachment scheme used by a particular air gap assembly.

The decorative attachment 12 includes some type of decorative item 24 and a decorative fastener 26. The decorative item 24 may be any aesthetic object, such as the bird shown, a person, a bird house, a piece of fruit or any other desirable item. A flat surface 28 is preferably formed on a bottom of the decorative item 24, such that the decorative fastener 26 may be attached thereto with adhesive or any other suitable attachment method. The decorative fastener 26 may also be made as an integral portion of the decorative attachment 12. The decorative fastener 26 preferably includes a mounting base 30 and a fastener projection 32 extending from a bottom of the mounting base 30.

The cover fastener 16 is sized to receive the fastener projection 32. The cover fastener 16 is preferably a female half turn threaded fastener and the fastener projection 32 is preferably a male half turn threaded fastener, but other types of fasteners may also be used. The cover fastener 16 could also be formed in the decorative attachment 12 and the decorative fastener 26 attached to a top of the base cover 10. The decorative attachment 12 is easily detachable to allow different designs of decorative attachments to be attached and detached to the base cover 10.

Figure 3:
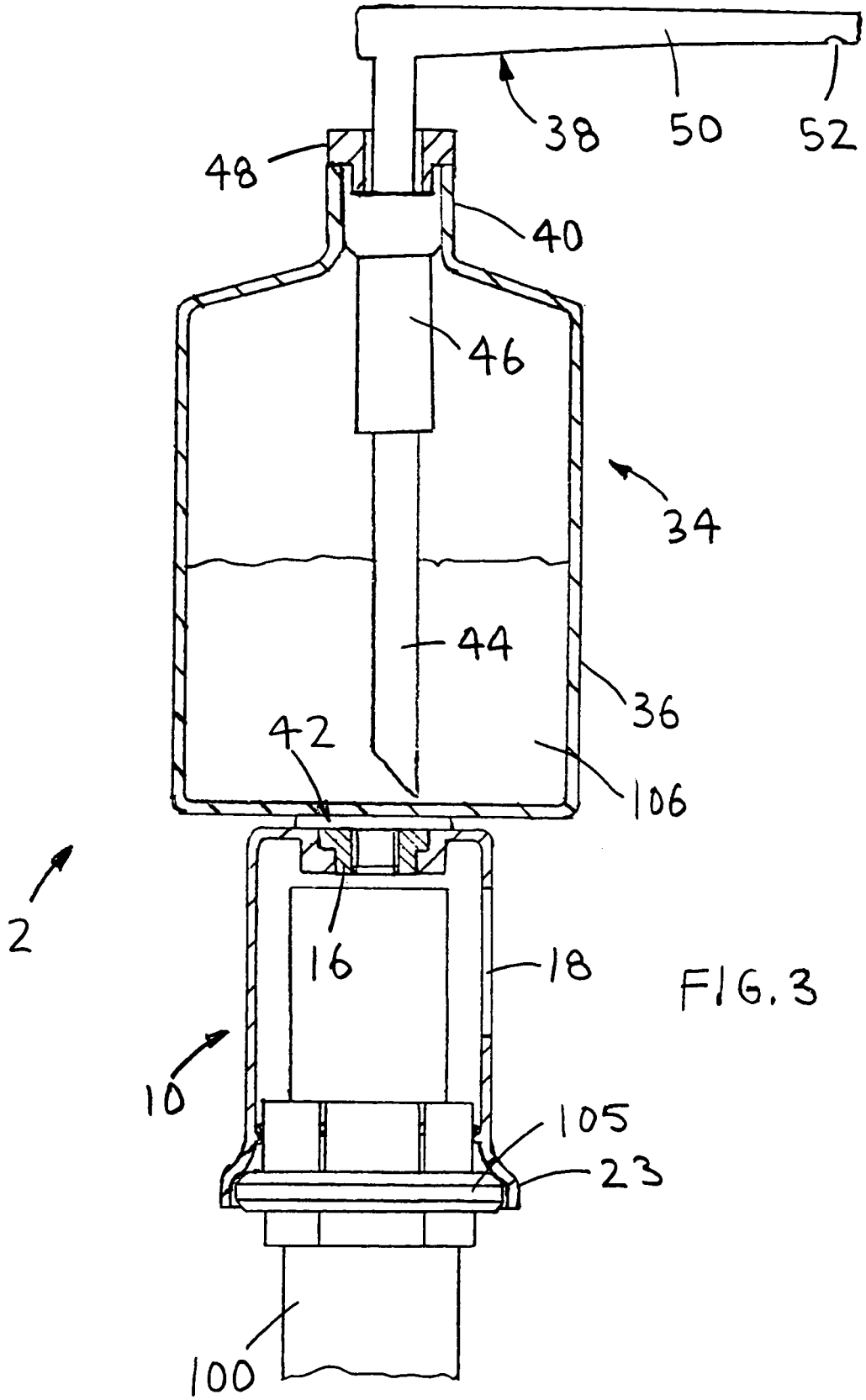
FIG. 3 is a cross sectional view of a liquid dispenser air gap cover attached to a top of an air gap assembly in accordance with the present invention.
Figure 4:
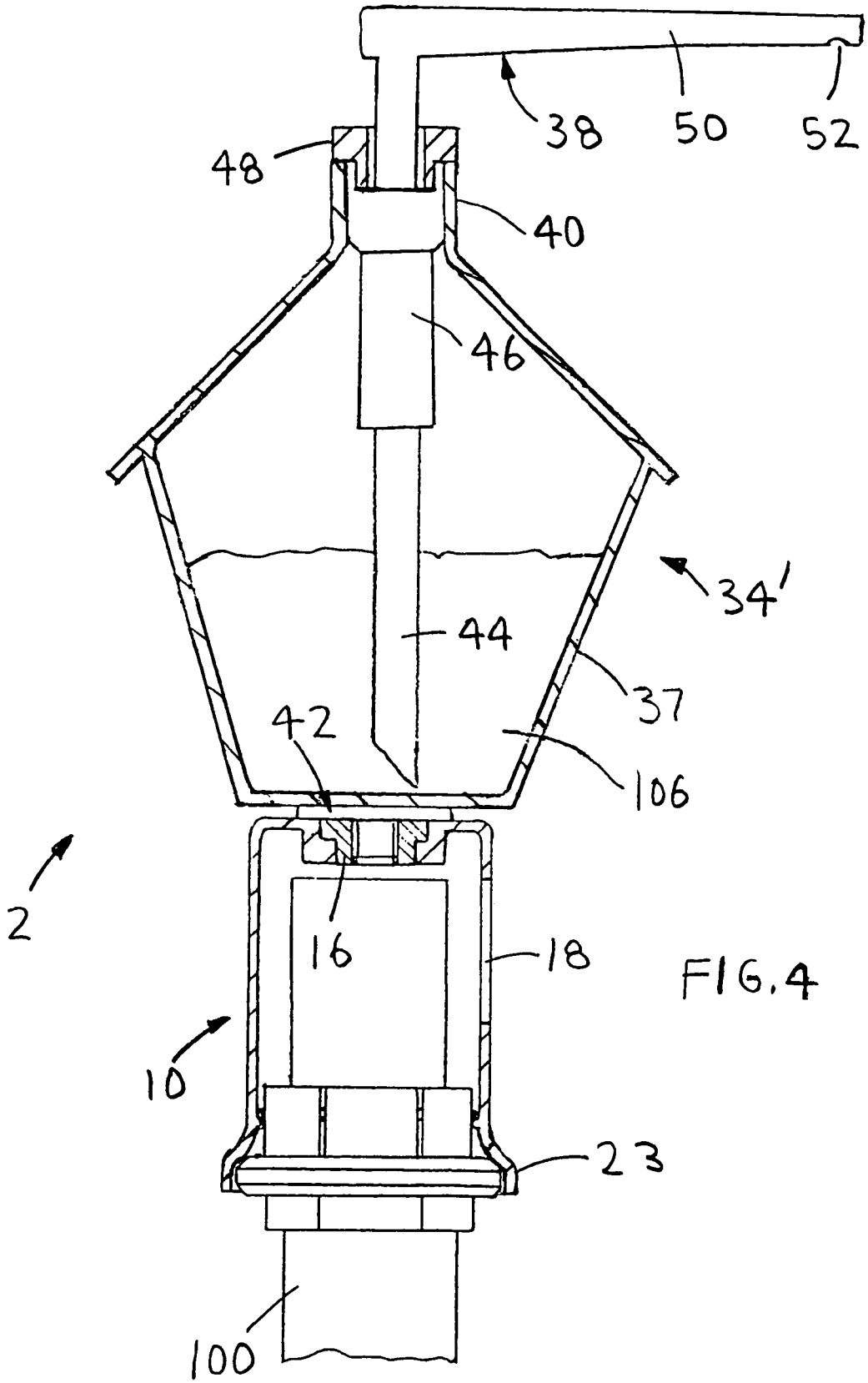
FIG. 4 is a cross sectional view of a liquid dispenser air gap cover with a bird house shaped liquid container attached to a top of an air gap assembly in accordance with the present invention.

With reference to FIG. 3, a liquid dispenser air gap cover 2 includes the base cover 10 and a liquid dispenser attachment 34. The liquid dispenser attachment 34 includes a liquid container 36 and a liquid pump 38. The liquid container 36 includes a neck 40 on a top and a liquid fastener 42 on a bottom thereof. With reference to FIG. 4, a liquid container 37 has the shape of a bird house. The liquid container may also have any other appropriate shape. The liquid fastener 42 includes all the features of the decorative fastener 26. The liquid fastener 42 is attached to a bottom of the liquid container 36 with adhesive or any other suitable attachment method. The liquid fastener 42 mates with the cover fastener 16 in the base cover 10. The liquid pump 38 includes a draw tube 44, a pump mechanism 46 a cap insert 48 and a dispensing tube 50. An inside perimeter of the neck 40 is sized to receive the cap insert 48. The cap insert 48 is formed on a top of the pump mechanism 46. The dispensing tube 50 extends from the top of the pump mechanism 46 and the draw tube 44 extends from a bottom of the pump mechanism 46.

A liquid such as soap 106 or the like is poured into the liquid container 36 and the liquid pump 38 is inserted into the neck 40. Pushing a top of the dispensing tube 50 downward causes liquid 106 in the liquid dispenser attachment 34 to be pushed through a nozzle 52. One type of liquid pump 38 is shown and described, but other designs of liquid pumps may also be used. Liquid pumps are well known in the art and do not require a detailed explanation. The liquid container 36 is shown with a particular shape, but other shapes or sizes may also be used.

Figure 5:
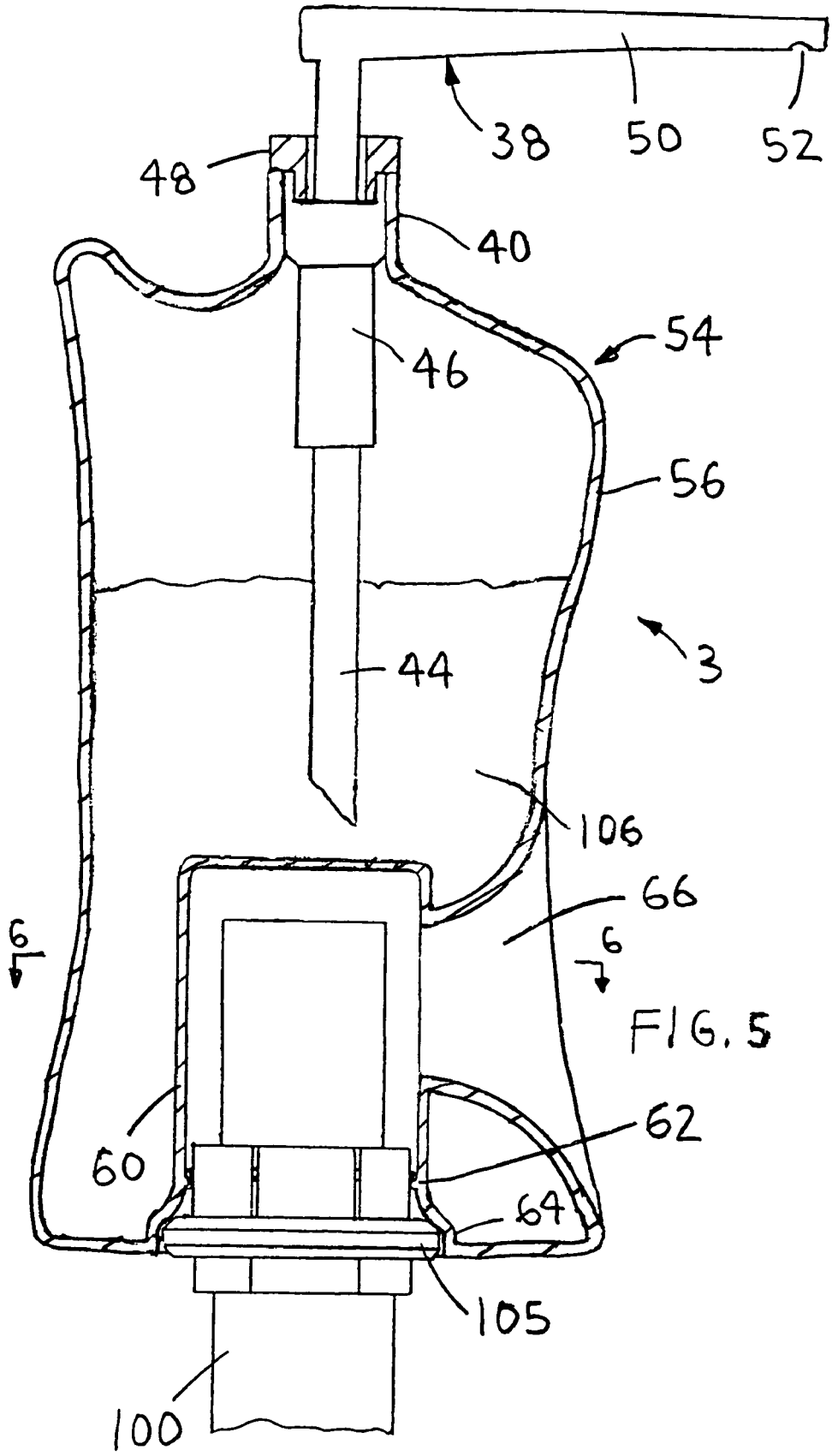
FIG. 5 is a cross sectional view of a second embodiment of a liquid dispenser air gap cover attached to a top of an air gap assembly in accordance with the present invention.
Figure 6:
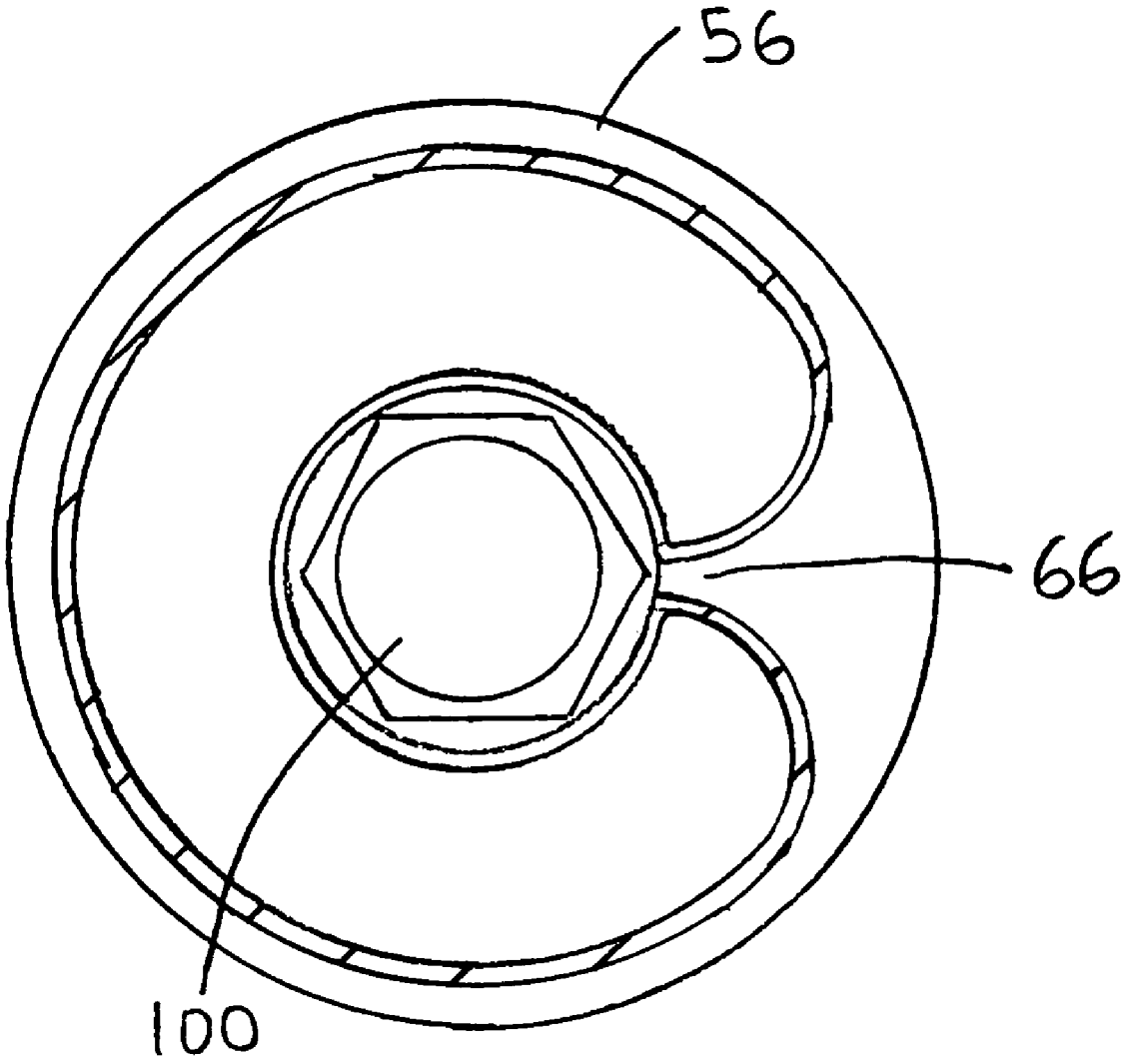
FIG. 6 is a horizontal cross sectional view of a second embodiment of a liquid dispenser air gap cover attached to a top of an air gap assembly in accordance with the present invention.

With reference to FIGS. 5–6, a liquid dispenser air gap cover 3 includes a liquid dispenser attachment cap 54. The liquid dispenser attachment cap 54 includes a liquid container 56 and the liquid pump 38. The liquid container 56 includes the neck 40 on a top and a base cover cavity 60 formed on a bottom thereof. A snap projection 62 is formed on the inside perimeter 20 of the base cover cavity at substantially a bottom thereof. However, the base cover cavity 60 may be modified to accommodate any of type attachment scheme used by a particular air gap assembly. A flared end 64 is preferably formed on a bottom of the base cover cavity 60 to cover a washer 105 of the air gap 100. An air slot opening 66 is formed as an integral portion of the liquid container 56. A liquid such as soap 106 or the like is poured into the liquid container 56.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A method of retaining a liquid dispenser on a top of an air gap assembly, comprising the steps of:

providing a liquid dispenser cap having a liquid container and a liquid pump, said liquid container including a neck formed on a top and a base cover cavity formed on a bottom thereof, said liquid pump being inserted into said neck of said liquid container, an air slot opening being formed adjacent said base cover cavity, said air slot opening formed as an integral portion of said liquid container, said base cover cavity including an inner diameter, said inner diameter being structured to be releasably secured to a top of an air gap assembly.

2. The method of retaining a liquid dispenser on a top of an air gap assembly of claim 1, further comprising the step of:

forming a snap projection on an inside perimeter of said base cover cavity to snap on to the top of the air gap assembly.

3. The method of retaining a liquid dispenser on a top of an air gap assembly of claim 1, further comprising the step of:

forming a thread on an inside perimeter of said base cover cavity to screw on to the top of the air gap assembly.

4. The method of retaining a liquid dispenser on a top of an air gap assembly of claim 1, further comprising the step of:

filing said liquid container with a liquid.

5. The method of retaining a liquid dispenser on a top of an air gap assembly of claim 1, further comprising the step of:

providing said liquid pump with a draw tube, a pump mechanism a cap insert and a dispensing tube, said dispenser tube extending from a top of said pump mechanism and said draw tube extending from a bottom of said pump mechanism, said cap insert extending from a top of said pump mechanism, said cap insert being sized to received by an inner perimeter of said neck.

6. A method of retaining a liquid dispenser on a top of an air gap assembly, comprising the steps of:

providing a liquid dispenser cap having a liquid container and a liquid pump, said liquid container including a neck formed on a top and a base cover cavity formed on a bottom thereof, said liquid pump being inserted into said neck of said liquid container, an air slot opening being formed adjacent said base cover cavity, said air slot opening formed as an integral portion of said liquid container, said base cover cavity including an inner diameter, said inner diameter being structured to be releasably secured to a top of an air gap assembly; and forming a snap projection on an inside perimeter of said base cover cavity to snap on to the top of the air gap assembly.

7. The method of retaining a liquid dispenser on a top of an air gap assembly of claim 6, further comprising the step of:

filing said liquid container with a liquid.

8. The method of retaining a liquid dispenser on a top of an air gap assembly of claim 6, further comprising the step of:

providing said liquid pump with a draw tube, a pump mechanism a cap insert and a dispensing tube, said dispenser tube extending from a top of said pump mechanism and said draw tube extending from a bottom of said pump mechanism, said cap insert extending from a top of said pump mechanism, said cap insert being sized to received by an inner perimeter of said neck.

9. A method of retaining a liquid dispenser on a top of an air gap assembly, comprising the steps of:

providing a liquid dispenser cap having a liquid container and a liquid pump, said liquid container including a neck formed on a top and a base cover cavity formed on a bottom thereof, said liquid pump being inserted into said neck of said liquid container, an air slot opening being formed adjacent said base cover cavity, said air slot opening formed as an integral portion of said liquid container, said base cover cavity including an inner diameter, said inner diameter being structured to be releasably secured to a top of an air gap assembly; and forming a thread on an inside perimeter of said base cover cavity to screw on to the top of the air gap assembly.

10. The method of retaining a liquid dispenser on a top of an air gap assembly of claim 9, further comprising the step of:

filing said liquid container with a liquid.

11. The method of retaining a liquid dispenser on a top of an air gap assembly of claim 9, further comprising the step of:

providing said liquid pump with a draw tube, a pump mechanism a cap insert and a dispensing tube, said dispenser tube extending from a top of said pump mechanism and said draw tube extending from a bottom of said pump mechanism, said cap insert extending from a top of said pump mechanism, said cap insert being sized to received by an inner perimeter of said neck.

* * * * *